United States Patent [19]

Ahn

[11] 3,973,336

[45] Aug. 10, 1976

[54] SHOES HAVING VENTS FOR VENTILATING FRESH AIR INTO THE INSIDE OF THE SHOES

[76] Inventor: Chang Kun Ahn, 283 Shinnae-dong, Dongdaemoon-Ku, Seoul, South Korea

[22] Filed: Apr. 29, 1975

[21] Appl. No.: 572,708

[52] U.S. Cl. ..... 36/3 B
[51] Int. Cl.[2] ..... A43B 7/06
[58] Field of Search ..... 36/3 R, 3 A, 3 B

[56] References Cited

UNITED STATES PATENTS

| | | | |
|---|---|---|---|
| 2,010,151 | 8/1935 | Helwig | 36/3 B |
| 2,153,304 | 4/1939 | Gruber | 36/3 R |
| 2,676,422 | 4/1954 | Crawford | 36/3 R |
| 3,225,463 | 12/1965 | Burnham | 36/3 R |

*Primary Examiner*—Patrick D. Lawson
*Attorney, Agent, or Firm*—Wenderoth, Lind & Ponack

[57] ABSTRACT

A shoe having ventilating means for supplying fresh air to the interior of the shoe has a base sole and an inner bottom sole defining between them an air distributing chamber and a space for accommodating an air supplying chamber to the rear of the air distributing chamber. The inner sole has an aperture therein between the air distributing chamber and the interior of the shoe for passing air from the air distributing chamber to the interior of the shoe. A collapsible resilient air supplying chamber is provided in the space for accommodating the air supplying chamber and having an air distributing conduit extending therefrom into the air distributing chamber and having an air intake conduit extending thereinto from outside of the shoe. Counterflow preventing valve means are provided in each conduit, and a rigid press member has a forward end anchored in one of the soles and has the rear end extending into the space for accommodating the air supplying chamber above the air supplying chamber. When a wearer in walking in the shoe raises the rear part of the shoe, the air supplying chamber is pressed against the press member for pumping the air supplying chamber into the air distributing chamber and thence into the interior of the shoe, and when the rear part of the shoe is lowered and the air supplying chamber regains its initial shape, fresh air is induced into the air supplying chamber through the air intake conduit.

4 Claims, 6 Drawing Figures

SHOES HAVING VENTS FOR VENTILATING FRESH AIR INTO THE INSIDE OF THE SHOES

DETAILED EXPLANATION OF INVENTION

This invention relates to shoes having ventilation means that can supply fresh air to the inside of the shoes during walking. More particularly, according to this invention, when a wearer walks on the roads or he makes only an up-and-down movement of the rear part of the shoes, after he puts on the shoes of this invention, fresh air will be supplied to the inside of the shoes.

When a wearer wears on common shoes such as leather shoes, sports shoes, or soldiers' boots for a long time in summer, the feet will perspire a lot around the toes and leg and spread bad smells, and this may cause water-eczema. For example, soldiers wearing combat boots for a long time have extremely severe problems with the above-mentioned difficulties because the boots have a large air tight area.

According to this invention, a press member is provided to assist the supply of air stored in an air tube to an air ventilating member when the front part of the shoe is bent. However, the press member has special shape of a slightly curved surface sloping upwardly from one end to the other. The front end of the press member is fixed tightly in the shoe sole and the other end of the press member extends into the space within an air supplying chamber so that, when the wearer steps forward, the front part of the shoe is bent and the rear end of the press member will have the air tube pressed against it because the air tube is located in the air supplying chamber placed in the rear part of the shoe.

In the air supplying chamber, there is the air tube that is easily restored to its original state due to its own elasticity. On the ends of this tube, there is an air inducing valve and an air distributing valve, respectively. The valves in the air tube act as counterflow-preventing valves.

Fresh air is supplied into the air tube through an air inducing conduit. In order to prevent the induction of dust, rainwater, or anything that may fill the inlet or the air inducing conduit, the inlet of the air inducing conduit must be placed on the neck of the back side of the shoe. However, in combat boots or in workers' boots, the inlet of the air inducing conduit may be installed on a suitable high place of the back side of the shoes.

The air distributing conduit is connected with the air ventilating member through which the fresh air in the air tube is ventilated into the inner side of the shoes. The ventilating member is placed on the front part of the inner bottom sole so that, when an user puts on the shoes of this invention, the toes will be located on this ventilating member. However, the ventilating member is covered with the net cloth having good ventilation effects.

The air tube located between the air inducing conduit and the air distributing conduit has the counterflow-preventing valves on the both ends of it. However, in order to provide for good air ventilation effect between the air inducing conduit and the air distributing conduit, the valve consists of a core having the air supply hole. And the surface of the core is wrapped with good elastic gum band to form a screw-shape air supply line on it and the both ends of the gum band are adhered on it.

When an user putting the shoes of this invention goes on foot, the front part of the sole is bent and the back part of the shoes is risen upwardly. In such case, the air tube in the air supplying chamber may touch with the press member extended into the air supplying chamber because the rear part of the shoes having the air tube is risen upward. And, because the air tube is touched with and pushed by the press member, the air in the air tube is supplied to the air distributing conduit and the air is ventilated into the inner side of the shoes where the toes are placed on. When the air tube is touched with the press member, the air inducing valve in the air tube is closed and the air distributing valve is opened so that the air in the air tube can be supplied to the air distributing conduit to ventilate the air into the inside of the shoes.

When the rear part of the inner bottom sole moves down, the air tube which has been compressed during the rise of the back part of the sole is released from the press member. When the air tube is released, the air tube induces fresh air while the air tube is restored to its original state due to its own elasticity. In such case, the air supply valve is opened and the fresh air is induced into the air tube, whereas the air distributing valve is closed.

At each of the wearer's steps, fresh air is pumped into the inside of the shoes, and, in summer, even when the wearer wears the shoes for a long time, perspiring around the toes and the foot can be prevented. A wearer who wears these shoes will not feel any discomfort.

BRIEF EXPLANATION OF THE DRAWINGS

A more detailed description of the invention will be given in connection with the accompanying drawings, in which.

DETAILED EXPLANATION OF THE INVENTION

Figure 1:
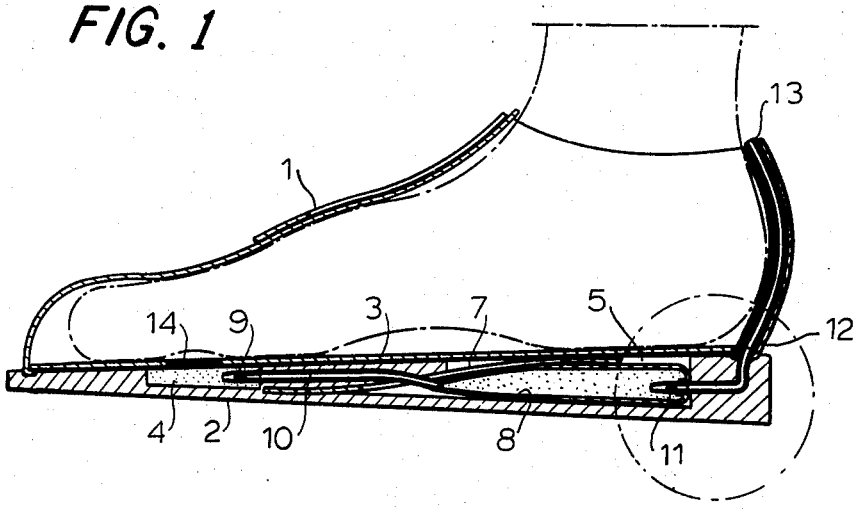
FIG. 1 is a longitudinal sectional view of a shoe of this invention.
Figure 2:
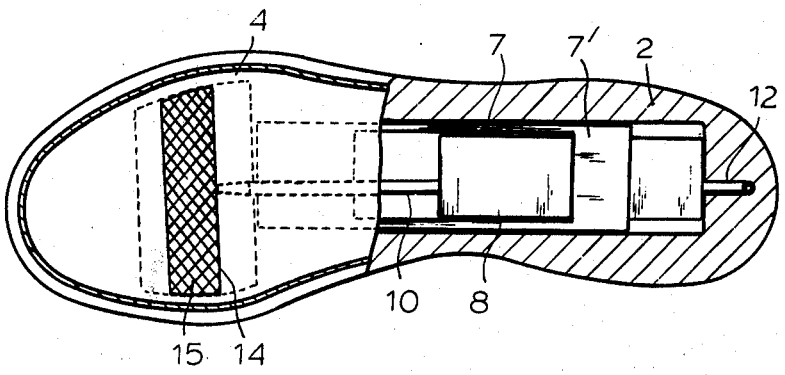
FIG. 2 is a sectional view partly cut away of the sole of the shoe of this invention.
Figure 3:
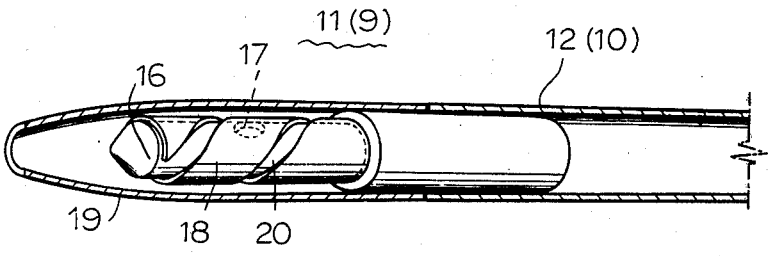
FIG. 3 is a perspective diagram of the counterflow-preventing valve used in the shoe of this invention.
Figure 4:
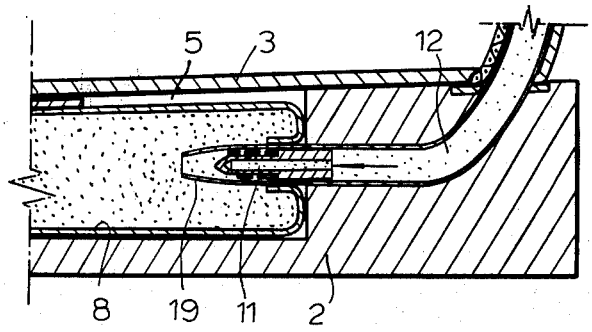
FIG. 4 is an enlarged sectional view of the rear part of the shoe of the invention.

According to this invention, an air distributing chamber (4) and an air supplying chamber (5) are provided between the base sole (2) and the inner bottom sole (3) of a shoe (1). A press member (7) has a central opening (6) therein and the rear end (7') of the press member (7) is located against the air supplying chamber (5), whereas the front end of the press member (7) is fixed in the base sole (2).

Fresh air is induced into the air tube (8) in the air supplying chamber (5) and the air in the air tube (8) is supplied into the air distributing chamber (4). The air supplying chamber (5) has an air tube (8) that the front end is connected with an air distributing conduit (10) having a counterflow-preventing valve (9) therein and the rear end is connected with an air inducing conduit (12) having a counterflow-preventing valve (11) therein, respectively. The inlet (13) to the air inducing conduit (12) is located on the upper end of the rear side of the shoes (1) or any other suitable area of the shoe.

An air ventilating member 14 on the near side of the air distributing chamber (4) constitutes a part of the inner bottom sole (3) of the shoe (1) and, when wears the shoe of this invention, the toes will be located on this ventilating member 14. The ventilating member 14 is constituted by a loosely woven cloth (15) having good ventilation effects.

The ends of the tube (8) have the counterflow-preventing valve (9) and (11) thereat: one is in the air inducing conduit (12) and the other in the air distributing conduit (10), respectively. However, in order to provide for an easy supply of fresh air into the air tube (8) and to prevent the counterflow of air, the valve is comprised to a tube 16 having a hollow center and a lateral air supply hole (17) opening out of the hollow center. The tube is spirally wrapped with an elastic band (18) to define a screw-shaped air supply passage (20). The band covers hole 17, and the ends of the band (18) are adhered to the surface of the core (16). This structure is inserted into a cover (20) to complete the counterflow-preventing valve of this invention.

Figure 5:
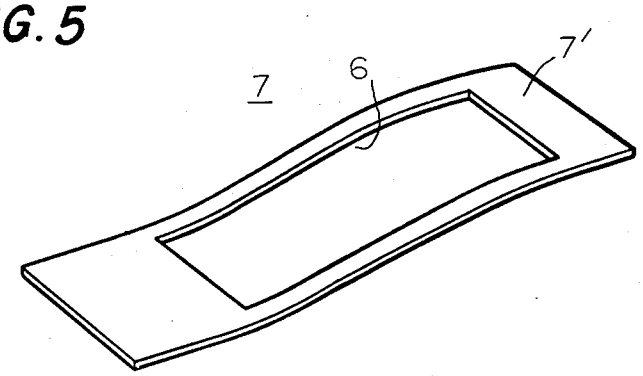
FIG. 5 is a perspective view of the press member.
Figure 6:
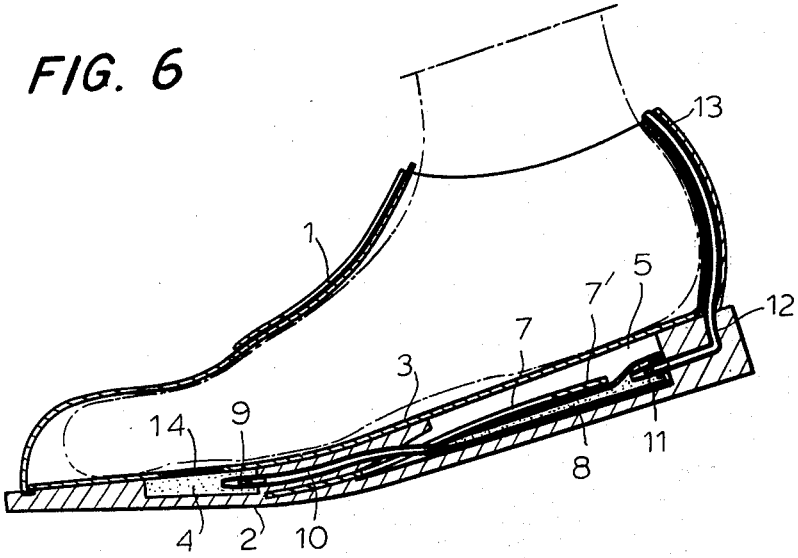
FIG. 6 is a sectional view of the shoe similar to FIG. 1 of the shoe in the operating condition.

According to the shoe of this invention, the base sole (2) and the inner bottom sole (3) of the shoe (1) maintains the shape of similar parts of ordinary shoes and the shape of the inner bottom sole 3 is not changed during walking or running. The press member 7, the front end of which extends into the base sole 2, must maintain a constant shape as shown in FIG. 5 so that the rear end 7′ thereof can be contacted by the air tube (8) with each step during walking.

As noted above, because the press member (7) is contacted by the air tube (8) repeatedly with each step during walking, the air tube (8) located in the air supplying chamber (5) is repeatedly compressed so as to cause induction and distribution of fresh air. When the air tube (8) is pressed against the rear end 7′ of the press member (7), the fresh air is pumped into the distributing chamber (4), whereas, when the tube (8) is released during the descent of the rear end of the shoe, the tube is restored to its original state and simultaneously fresh air is induced into the air tube (8). Repetition of these actions during walking cause the supply and the distribution of fresh air to take place continuously and the wearer will not feel any discomfort during walking.

In order to prevent undesired materials such as dust or water, etc., from entering the shoe, the inlet (13) supplying the fresh air is installed on a high place of the rear and of the shoe and, by the air inducing conduit (12) connected with the inlet (13), fresh air is supplied to the air tube (8). The fresh air induced into the air tube (8) through the air inducing conduit (12) will not flowback past the screw-shaped elastic band (18) wrapped around the surface of the core (16) when the air stored in the tube (8) is pumped to the air distributing chamber (4) through the air distributing conduit (10) when the air tube (8) is pressed against the free end (7′) of the press member (7). When the rear part of the shoe is raised, the air tube (8) is also raised and the air tube (8) is pressed against the press member (7). On the contrary, when the rear part of the shoe moves down to its normal position, the air tube (8) is separated from the press member (7) and returns to its original state due to its own elasticity and thus the fresh air is induced into the air tube (8).

In the valves 9 and 11, in order to induce a smooth supply of the air into the tube (8) from the air inducing conduit (12) and to eliminate noise during the the supply and the distribution of air, it is necessary to wrap the core (16) with good elastic band (18) in a screw-shape.

The purpose of the press member is simply to provide a support against which to press the air tube 8 when the sole is raised. Since during the up and down movement of the rear part of the shoe the supply and distribution of the fresh air is repeatedly accomplished, there is no need to add another elastic means to induce any up-and-down movement of the press member.

The air tube 8 must be able to return to its original state due to its own elasticity when the air tube is released from the press member. However, the upper part of the air tube that contacts the press member during the rise of the rear part of the shoe must be hard.

The press member (7) has a central space (6) and its front end is fixed tightly in the base sole (2) and the other end extends into the space for the air supplying chamber (5).

Because the supply of the fresh air can be accomplished by the up-and-down movement of the rear part of the shoe, even if the wearer does not actually walk, if the wearer makes repeated up-and-down movements of the rear part of the shoe, supply of fresh air into the air tube in the air supplying chamber and supply of air into the interior of the shoe through the air ventilating chamber can be successfully carried. Therefore, the wearer can always keep his toes and foot cool and free from sweat, and the wearer can use this shoe as an ordinary one without causing any discomfort during walking.

I claim:

1. A shoe having ventilating means for supplying fresh air to the interior of the shoe, comprising a base sole and an inner bottom sole defining between them an air distributing chamber and a space for accommodating an air supplying chamber to the rear of the air distributing chamber, said inner sole having an aperture therein between said air from the air distributing chamber to the interior of the shoe, a collapsible resilient supplying chamber in the space for accommodating said air supplying chamber and having an air distributing conduit extending therefrom into said air distributing chamber and having an air intake conduit extending thereinto from outside of said shoe, counterflow preventing valve means in each conduit, and a rigid press member having a forward end anchored in one of said soles and having the rear end extending into said space for accommodating said air supplying chamber above the air supplying chamber, whereby when a wearer in walking in the shoe raises the rear part of the shoe, the air supplying chamber is pressed against the press member for pumping the air supplying chamber into said air distributing chamber and thence into the interior of the shoe, and when the rear part of the shoe is lowered and the air supplying chamber regains its initial shape, fresh air is induced into the air supplying chamber through the air intake conduit.

2. A shoe as claimed in claim 1 in which said air intake conduit has the end thereof on the outside of the shoe at an elevated point on the back of the shoe, whereby dust, dirt and other undesired material is not likely to enter the air intake conduit.

3. A shoe as claimed in claim 1 in which said counterflow preventing valves each comprise a generally tubular shaped body having a hollow center and a lateral air supply hole, and an elastic band wrapped spirally around said tube over said hole and secured at both ends to said tube.

4. A shoe as claimed in claim 1 in which said press member has a central aperture therein and has the forward end anchored in said base sole and said air supplying chamber extending through said central aperture with the rear end of the press member above said air supplying chamber.

* * * * *